US009549651B2

(12) United States Patent
Cooper

(10) Patent No.: US 9,549,651 B2
(45) Date of Patent: Jan. 24, 2017

(54) STEAM CLEANING DEVICE AND ACCESSORY

(71) Applicant: BLACK & DECKER INC., New Britain, CT (US)

(72) Inventor: Vincent Cooper, Durham (GB)

(73) Assignee: BLACK & DECKER INC., New Britain, CT (US)

( * ) Notice: Subject to any disclaimer, the term of this patent is extended or adjusted under 35 U.S.C. 154(b) by 0 days.

(21) Appl. No.: 14/934,362

(22) Filed: Nov. 6, 2015

(65) Prior Publication Data

US 2016/0128536 A1 May 12, 2016

(30) Foreign Application Priority Data

Nov. 7, 2014 (EP) ..... 14192235
Mar. 27, 2015 (EP) ..... 15161306

(51) Int. Cl.

| | |
|---|---|
| ***A47L 11/40*** | (2006.01) |
| ***A47L 11/34*** | (2006.01) |
| ***B08B 3/02*** | (2006.01) |
| ***A47L 13/18*** | (2006.01) |

(52) U.S. Cl.

CPC ..... *A47L 11/34* (2013.01); *A47L 11/4036* (2013.01); *A47L 11/4086* (2013.01); *A47L 13/18* (2013.01); *B08B 3/028* (2013.01); *B08B 2230/01* (2013.01)

(58) Field of Classification Search

CPC .. A47L 11/34; A47L 11/4086; A47L 11/4036; A47L 13/18; B08B 3/028; B08B 2230/01

See application file for complete search history.

(56) References Cited

U.S. PATENT DOCUMENTS 1,533,732 A * 4/1925 Frost ..... A47L 13/18 239/529
1,558,930 A * 10/1925 Schuck ..... A41D 19/0079 239/529
2,261,064 A 10/1941 Katz
2,578,188 A 4/1948 Ionides et al.
2,759,278 A 3/1953 Fray
3,793,753 A 2/1974 Engelbart (Continued)

FOREIGN PATENT DOCUMENTS

EP 2494901 9/2012
GB 2294196 4/1996

(Continued)

OTHER PUBLICATIONS

EP search report for EP Application No. 15161306 dated Mar. 14, 2016.

*Primary Examiner* — Dung Van Nguyen
(74) *Attorney, Agent, or Firm* — John Yun

(57) ABSTRACT

A steam cleaning accessory for use with a steam generator comprises a flexible sheath having a first side wall, a second side wall and a base there between. At least one steam conduit has at least one steam outlet. The at least one steam conduit is arranged to be in fluid communication with the steam generator. At least one flexible thermal insulation layer is mounted between the first and second side walls. The steam conduit is mounted on a first side of the base and the flexible thermal insulation layer is mounted on a second side of the base. A restraint is coupled to the flexible sheath and arranged to receive a user's hand.

14 Claims, 7 Drawing Sheets

(56) References Cited

U.S. PATENT DOCUMENTS

| | | | | |
|---|---|---|---|---|
| 5,091,243 | A | 2/1992 | Tolbert et al. | |
| 5,399,418 | A | 3/1995 | Hartmanns et al. | |
| 5,718,016 | A * | 2/1998 | Sung | A47L 5/24 15/227 |
| 5,749,120 | A * | 5/1998 | Amoretti | A47L 11/34 15/321 |
| 7,409,786 | B2 | 8/2008 | Lee | |
| 7,926,519 | B1 | 4/2011 | Wigent | |
| 8,459,273 | B2 * | 6/2013 | Silva | A45D 20/12 132/271 |
| 8,919,357 | B2 * | 12/2014 | Breit | B08B 3/00 134/105 |
| 2003/0157853 | A1 | 8/2003 | Huber | |
| 2012/0204375 | A1 * | 8/2012 | Charlton | A47L 11/4036 15/320 |

FOREIGN PATENT DOCUMENTS

| | | |
|---|---|---|
| JP | 2008011973 | 1/2008 |
| WO | WO02/43550 | 6/2002 |

* cited by examiner

STEAM CLEANING DEVICE AND ACCESSORY

CROSS-REFERENCE TO RELATED APPLICATIONS

This application claims priority to European Patent Application No.14192235.1 filed Nov. 7, 2014, and European Patent Application No. 15161306.4 filed Mar. 27, 2015. The entire contents of that application are expressly incorporated herein by reference.

FIELD OF THE INVENTION

The present invention relates to a steam cleaning device and accessory.

BACKGROUND OF THE INVENTION

In recent times steam cleaning has become desirable in the domestic environment. A known steam cleaner is shown in EP2494901 which has a boiler for generating steam and a cleaning head for directing the steam to a surface to be cleaned. The cleaning head is designed to engage a floor surface. The size of the steam cleaner and the construction of the cleaning head means that it is difficult to clean surfaces other than the floor.

BRIEF SUMMARY OF THE INVENTION

A cleaning device which is convenient to use for indoor domestic tasks is desirable. Embodiments of the present invention aim to address the aforementioned problems.

In one aspect of the invention there is provided a steam cleaning accessory for use with a steam generator comprising: a flexible sheath having a first side wall, a second side wall and a base there between; at least one steam conduit having at least one steam outlet, the at least one steam conduit being arranged to be in fluid communication with the steam generator; and at least one flexible thermal insulation layer mounted between the first and second side walls; wherein the steam conduit is mounted on or in a first side of the base and the flexible thermal insulation layer is mounted on a second side of the base; and a restraint is coupled to the flexible sheath and arranged to receive a user's hand.

The steam cleaning accessory is conveniently wearable on the user's hand. Furthermore the steam cleaning accessory comprises a plurality of layers, each of which is flexible and one of the layers delivers and outputs steam. This makes a convenient a deformable steam cleaning accessory which outputs steam at a temperature which kills germs. In particular the steam cleaning accessory is convenient for sanitizing non-flat surfaces such as toilets, taps, shower heads and sinks.

In comparison one known hand held cleaning accessory is shown in DE9314368 which comprises a washing glove for cleaning cars and animals. However this washing glove is only suitable for use with water. The washing glove has an upper part for receiving the user's hand and a wash pad receives water from a hose connection. The problem with this cleaning accessory is that it is only suitable for outdoor use where large quantities of waste water can easily be managed.

However many indoor domestic cleaning tasks cannot be carried out with a large flow of running water because the water will cause damage or create more mess. For example the water may drip onto other surfaces when wiping vertical surfaces such as cupboard doors or and the water may fill up a refrigerator drip tray when cleaning the inside of a refrigerator. In contrast the steam cleaning accessory of the present invention is able to clean and sanitize surfaces without the concern that water will drip off a vertical surface or interfere with the operation of a refrigerator.

Preferable the at least one conduit is at least one steam bladder. The steam bladder can be easy to manufacture and mount on the flexible sheath.

Preferably the flexible sheath comprises single moulded material. By manufacturing the flexible sheath from a single piece of material, the steam cleaning accessory is more robust because the flexible sheath constrains the other parts of the accessory. In addition the steam cleaning accessory is easier to manufacture because the part of the accessory are bonded to the flexible sheath and processes such as stitching are not required.

Preferably the base comprises a recess or a window for receiving the at least one steam bladder. This means that the steam bladder is flush with the underside of the base of the flexible sheath. This means that the underside of the steam cleaning accessory is smooth and will better engage flat surfaces.

Preferably the first and second side walls substantially surround the periphery of the at least one flexible thermal insulation layer. In this way sharp or scratchy edges of the flexible thermal insulation layer are not exposed and this reduced irritation on the user's skin.

Preferably the at least one flexible thermal insulation layer is bonded to the first and second side walls and/or the base. This makes manufacture of the steam cleaning accessory easier because a bead of glue is located around the side walls and/or base and the flexible thermal insulation layer is simply inserted into the flexible sheath.

Preferably the restraint is integral with the flexible sheath.

Preferably the at least one steam bladder comprises an inner flexible layer and an outer flexible layer bonded together substantially around a periphery. Preferably the inner flexible layer is the base of the flexible sheath or a flexible layer bonded to the base. Preferably the inner flexible layer and the outer flexible layer are bonded together at least one point between the periphery. By providing the steam bladder from an inner and an outer flexible layer, the steam bladder is easier to manufacture. The flat surface of the steam bladder adheres better to the flat underside of the base of the flexible sheath. The orientation and alignment of the holes is maintained during manufacture and the likelihood of the steam bladder being punctured is reduced.

Preferably the at least one flexible thermal insulation layer comprises a resilient material arranged to return to a predetermined shape after being deformed. Preferably the resilient material comprises a first fabric layer and a second fabric layer and the first and second fabric layers are separated by resilient flexible threads knitted between the first and second fabric layers. This means that the resilient material can keep the air inlet and air outlet open even when the steam cleaning accessory is being deformed and flexed.

Preferably the at least one flexible thermal layer comprises a first flexible thermal insulation layer and a second flexible thermal insulation layer. Preferably the second flexible thermal insulation layer is separable from the first flexible thermal insulation layer. This means that the second and first thermal insulation materials can be separated to be cleaned and the steam ducts do not have to be washed at the same time as the first thermal insulation material.

Preferably the at least one steam conduit is bonded to the second flexible thermal insulation layer.

Preferably the flexible cleaning element is one or more of the following a cleaning cloth, a scourer, bristles, or a sponge. Preferably the flexible cleaning element is removeably mounted to the at least one flexible thermal insulation layer. This means that the flexible cleaning element can be separately cleaned from the rest of the steam cleaning accessory. In addition the flexible cleaning element can be replaced when necessary.

Preferably a flexible cleaning element is removeably mountable adjacent to the at least one steam outlet.

In another aspect of the invention there is a steam cleaning device comprising; a steam cleaning accessory according to the aforementioned aspects of the invention; and a steam generating device coupled to the adaptor.

In another aspect of the invention there is a method of manufacturing a steam cleaning accessory for use with a steam generator comprising: moulding a flexible sheath having a first side wall, a second side wall and a base there between; mounting at least one steam conduit on a first side of the base, the at least one steam conduit having at least one steam outlet; and mounting at least one flexible thermal insulation layer mounted between the first and second side walls and on a second side of the base; wherein a restraint is coupled to the flexible sheath and arranged to receive a user's hand.

In another aspect of the invention there is steam cleaning accessory for use with a steam generator comprising: an adaptor for coupling to the steam generator; at least one steam conduit in fluid communication between the adaptor and at least one steam outlet; a flexible cleaning element for engaging with a surface, wherein the cleaning element is steam permeable; at least one flexible thermal insulation layer wherein the at least one steam conduit is mounted between the at least one flexible thermal insulation later and the flexible cleaning element; and a flexible restraint mounted on the flexible thermal insulation and the flexible restraint is arranged to receive a user's hand.

BRIEF DESCRIPTION OF THE DRAWINGS

Various other aspects and further embodiments are also described in the following detailed description and in the attached claims with reference to the accompanying drawings, in which:

DETAILED DESCRIPTION OF THE INVENTION

Figure 1:
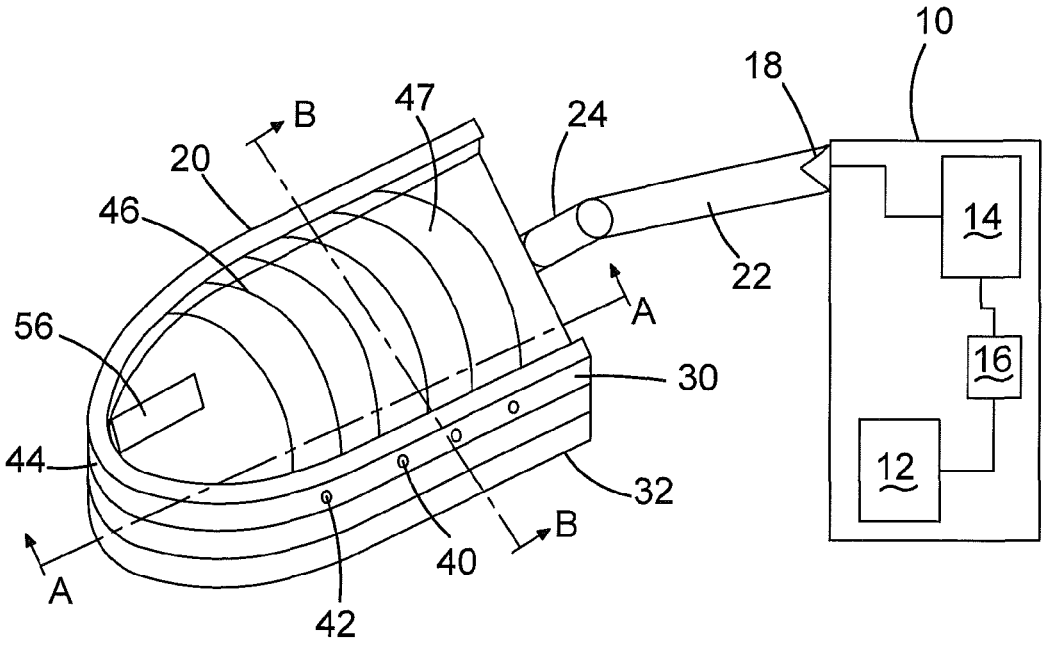
FIG. 1 shows a schematic representation of the steam cleaning device and accessory according to an embodiment.

FIG. 1 shows a schematic perspective view of a steam cleaning device 10. The steam cleaning device 10 comprises a water tank 12 and a steam generator such as a boiler 14. A pump 16 pumps water to the boiler 14. The boiler 14 comprises a resistive element and is powered by a source of electrical energy such as mains electricity or battery. Steam is generated by the boiler 14 and output at a steam nozzle 18 (or any other suitable steam outlet of the steam cleaning device 10).

The steam cleaning device 10 is coupled to a steam cleaning accessory 20 by a steam hose 22 and an adaptor 24. The adaptor 24 which is mounted on the steam cleaning accessory 20 and is arranged to couple the steam cleaning accessory 20 with the steam nozzle 18 such that the steam cleaning device 10 is in fluid communication with the steam cleaning accessory 20 via the steam hose 22.

The steam cleaning device 10 comprises a coupling for fixing the steam hose 22 to the steam nozzle 18. The steam hose 22 is detachable from the adaptor 24 allowing the steam cleaning device 10 to be used with other steam cleaning accessories. The steam cleaning device 10 is handheld and the steam cleaning accessory 20 is wearable on the other hand of the user. Of course, the user can also wear the steam cleaning accessory 20 without holding the steam cleaning device 10 at the same time. The steam hose 22 is of sufficient length such that the steam cleaning accessory 20 can be moved without constantly moving the steam cleaning device 10.

For example, in some embodiments the steam hose 22 is about 50 cm to 100 cm in length. This means that steam hose 22 is about the same length as a user's arm and the user can move the steam cleaning accessory 20 without moving the steam cleaning device 10 when held in the other hand.

Although not shown in FIG. 1, in some other embodiments the steam hose 22 is fixed to the steam cleaning accessory 20 and the adaptor 24 is mounted at the end of the steam hose 22. When the adaptor 24 is mounted at the end of the steam hose 22, the adaptor 24 couples the steam hose 22 to the steam nozzle 18.

Figure 2:
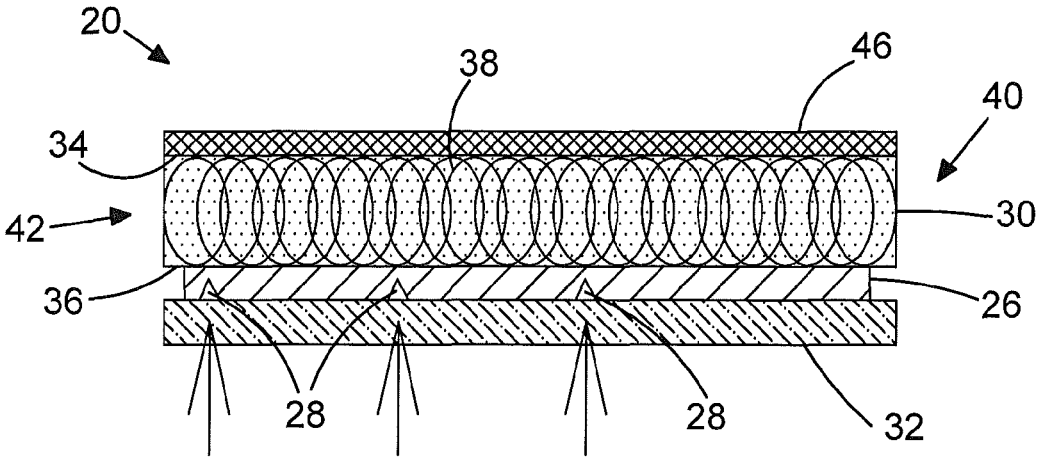
FIG. 2 shows a cross sectional side view of the steam cleaning accessory according to an embodiment.

The steam cleaning accessory 20 will now be described in more detail with reference to FIGS. 2 to 8. FIG. 2 shows a side cross sectional view of the steam cleaning accessory 20 along the line A-A in FIG. 1. The steam cleaning accessory 20 comprises a steam conduit or steam duct 26. The steam duct 26 is in fluid communication with the adaptor 24 and the steam cleaning device 10. The steam duct 26 in some embodiments is a silicone tube which extends over the steam cleaning accessory 20. The steam duct 26 comprises one or more steam outlets 28 for allowing steam to be released from the steam duct 26.

The steam duct 26 is mounted between a flexible thermal insulation layer 30 and a flexible cleaning element 32. Although not shown, the flexible cleaning element 32 is also fixed to the flexible thermal insulation layer 30. The flexible cleaning element 32 is steam permeable and the steam outlets 28 face the flexible cleaning element 32. The flexible cleaning element 32 is steam permeable by virtue that the flexible cleaning element 32 is a material which comprises holes for allowing steam to pass there through. In some embodiments the flexible cleaning element 32 is a fabric material such as a woven fabric material. The woven fabric material has holes between the threads and the holes allow the steam to pass through. Alternatively the flexible cleaning element 32 is a substantially non steam permeable material, but the flexible cleaning element 32 comprises through holes for allowing the passage of steam through the flexible cleaning element 32.

In some embodiments the flexible cleaning element 32 is a cleaning cloth which is suitable for wiping along dirty surfaces. In other embodiments the flexible cleaning element 32 can be one or more of the following, a cleaning element with bristles, brush, a scourer, sponge, pad or any suitable material for cleaning and wiping a dirty surface. Since the flexible cleaning element 32 is deformable, the flexible cleaning element 32 can be wrapped around curved surfaces such as taps, sinks and the like.

As mentioned above, the steam duct 26 is sandwiched between the flexible cleaning element 32 and the flexible thermal insulation layer 30. The flexible thermal insulation layer 30 is a barrier layer which limits the transmission of the thermal energy across the steam cleaning accessory 20. The flexible thermal insulation layer 30 can be any suitable thermal insulation layer which is flexible. For example in some embodiments the flexible thermal insulation layer 30 is a silicone layer.

In some alternative embodiments, and as shown in FIG. 2, the flexible thermal insulation layer 30 is a spacer fabric. The spacer fabric comprises a first layer 34 of fabric and a second layer 36 of fabric and the first and second layers are separated by at least one resilient thread 38 knitted there between. This means that the spacer fabric comprises an air inlet 40 and an air outlet 42 and an air flow pathway between the two. The air inlet 40 and the air outlet 42 can be located in any position on the flexible thermal layer 30 and there may be any number of air inlets 40 or air outlets 42. This means that the convection of air is increased around and through the flexible thermal insulation layer 30. In some embodiments the first layer 34 and the second layer 36 of the spacer fabric are a mesh or net like material and comprise a plurality of holes which promote air flow within the flexible thermal insulation layer 30.

The inventor has realised that a flexible thermal insulation layer 30 with at least one an air inlet 40 and an air outlet 42 with an air flow pathway between them is an effective way of preventing thermal energy building up in the steam cleaning accessory 20 from the continual use of the steam cleaning accessory 20. The embodiments discussed herein dissipate the thermal energy from the steam cleaning accessory 20 by convection of the surrounding air through the steam cleaning accessory 20.

In some other embodiments the flexible thermal insulation layer 30 comprises a foam material which comprises holes allowing air to pass there through. In other embodiments the thermal insulation layer 30 is a solid material such as a silicone layer with holes bored into the centre of the material for allowing air to circulate through the centre of the silicone layer.

Briefly turning to FIG. 1, the flexible thermal insulation layer 30 optionally comprises at least one of the air inlet 40 and the air outlet 42 in a peripheral side 44 of the steam cleaning accessory 20. By having air holes in the peripheral side 44 of the steam cleaning accessory 20, when the steam cleaning accessory 20 is moved from side to side, air from the external environment is encouraged to move along the air flow pathway. This means cool air from outside the steam cleaning accessory 20 replaces the warmer air within the flexible thermal insulation layer 30 each time the steam cleaning accessory 20 is moved from side to side. The air inlet 40 and the air outlet 42 can optionally be in alternative positions around the thermal insulating later 30.

A flexible retaining layer 46 is mounted on the flexible thermal insulation layer 30. The flexible retaining layer 46 is fixed to the side of the flexible thermal insulation layer 30 which is opposite to the side on which the steam duct 26 is mounted. The flexible retaining layer 46 in some embodiments is a flexible restraint for receiving the user's hand. The flexible restraint in some embodiments can be a flexible pocket 47. The flexible layer 46 creates a flexible pocket 47 between the retaining layer 46 and the flexible thermal insulation layer 30 in which the user can place their hand. When the user puts their hand in the flexible pocket 47, the flexible thermal insulation layer 30 and the retaining layer 46 deform around the hand. In this way the user is able to wear the steam cleaning accessory 20 in the same way they can wear a glove or a mitt. In use the user's palm is adjacent to the first fabric layer 34 of the flexible thermal insulation layer 30 and the back of the user's hand is adjacent to the flexible retaining layer 46. The flexible retaining layer 46 and the flexible pocket 47 allow the steam cleaning accessory 20 to be worn on the hand without physically gripping the steam cleaning accessory 20. This means the steam cleaning accessory 20 does not fall off the user's hand.

Optionally in some embodiments the retaining layer 46 is a mesh material or a net material. This provides air holes in the retaining layer 46 and increases the circulation of air around the user's hand which helps keep the user's hand cool.

In some embodiments the retaining layer 46 comprises an elasticated material which further grips the user's hand. The retaining layer 46 may also comprise one or more upstanding finger partitions 56 for separating a user's fingers. The finger partitions 56 aid the user's comfort when using the steam cleaning accessory 20. Optionally the retaining layer 46 may comprise a releasable cuff for wrapping around the user's wrist to help keep the steam cleaning accessory 20 on the user's hand.

The flexible restraint can be any suitable means for coupling the user's hand to the steam cleaning accessory 20. Alternatively the flexible restraint is one or more flexible straps which are mounted to the flexible thermal insulation layer 30. The flexible straps (not shown) pass over the back of the user's hand and/or wrist.

Figure 3:
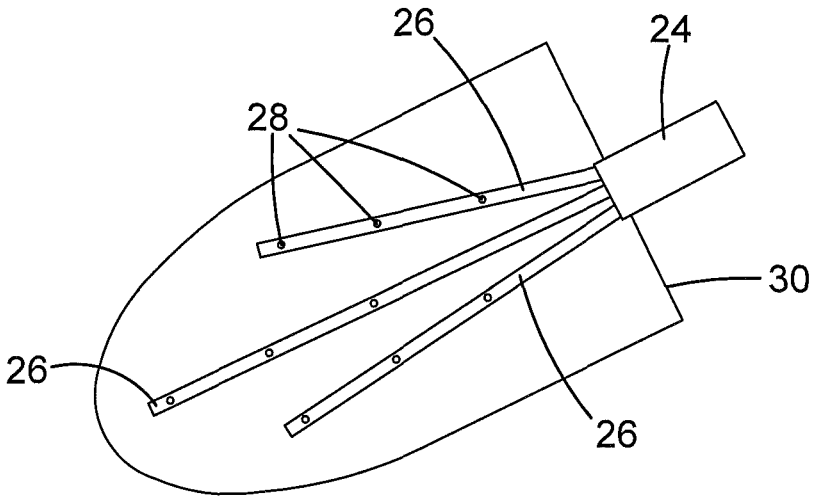
FIG. 3 shows a schematic representation of a partial view of the steam cleaning accessory.

The distribution of the steam duct 26 will now be discussed in further detail to FIG. 3. FIG. 3 shows an underneath plan view of part of the steam cleaning accessory 20. In particular FIG. 3 shows three steam ducts 26 mounted on the flexible thermal insulating layer 30. Each steam duct 26 is in fluid communication with the adaptor 24 and the steam cleaning device 10. The plurality of steam ducts 26 each comprises at least one steam outlet 28. FIG. 3 shows that each steam duct 26 has a plurality of steam outlets 28. The steam cleaning accessory 20 can have any number of steam ducts 26 and the steam ducts 26 can follow any path over the flexible thermal insulation layer 30.

Figure 4:
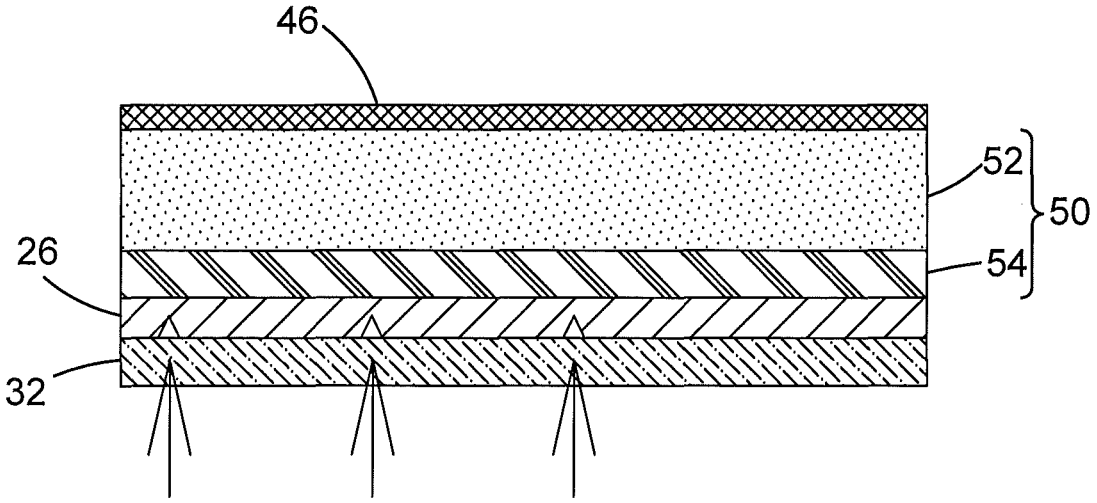
FIG. 4 shows a cross sectional side view of the steam cleaning accessory according to an embodiment.

Further embodiments will now be discussed in reference to FIG. 4. FIG. 4 shows a cross sectional side view of the steam cleaning accessory 20. The steam cleaning accessory 20 is similar to the embodiments discussed in reference to FIGS. 1 to 3. The same reference numbers will be used for the same features in previously mentioned embodiments. FIG. 4 differs in that the flexible thermal insulation layer 50 comprises a first flexible thermal insulation layer 52 and a second flexible thermal insulation layer 54. The first flexible thermal insulation layer 52 is the same as the flexible thermal insulation layer 30 in the embodiments described with respect to FIGS. 1 to 3. The second flexible thermal insulation layer 54 is a solid flexible layer on which the steam duct 26 is mounted. By separating the flexible thermal insulation layer 50 in to two different parts, a thinner composite material can be achieved. The solid flexible layer 54 is non-woven and reduces the amount of heat radiated from the steam ducts 26 to the user's hand. The second flexible layer can be a flexible layer of silicone. The first flexible thermal insulation layer 52 is thinner compared to the thermal insulation layer 30 in the embodiment discussed in FIG. 3. The boundary layer between the first and second layers 52, 54 also reduces the amount of thermal energy conducted through the materials.

By providing a silicone layer 54 or another non-woven thermally insulating material, the steam duct 26 is more easily bonded and fixed in place. In some embodiments the silicone tubes used for the steam duct 26 are bonded to the silicone layer 54 with a silicone based adhesive. In some other embodiments the silicone tube 26 and the silicone layer 54 are partially cured. During manufacture the partially cured silicone tubes 26 are placed in position on the partially cured silicone layer 54 and the arrangement is exposed to an elevated temperature. This cures both the silicone tube 26 to the silicone layer 54 which are both bonded to each other without the need for adhesive. In some other embodiments the steam duct 26 can be integral with the silicone layer 54. For example the steam duct 26 can be an embedded tube in the silicone layer. Alternatively the steam duct 26 can be an internal bore moulded within the silicone layer. The internal bore can be completely embedded within the silicone layer, an open channel in the underside of the silicone layer or a combination of an internal bore and an open channel.

Figure 5:
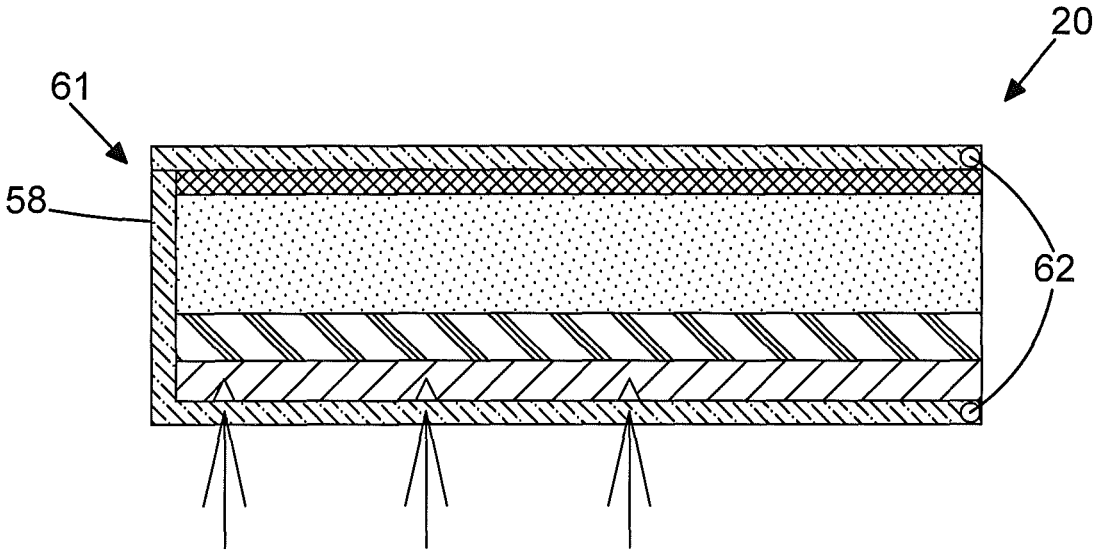
FIG. 5 shows a cross sectional side view of the steam cleaning accessory according to an embodiment.

Turning to FIG. 5 another embodiment of the steam cleaning accessory 20 will now be discussed. The steam cleaning accessory 20 is similar to the embodiment discussed with reference to the embodiments shown in FIG. 4 and the same reference numbers will be used to indicate the same features. FIG. 5 differs in that the flexible cleaning element 32 is removable and replaceable. The flexible cleaning element 32 as shown in FIG. 5 is a replaceable cleaning sock 58 which covers the entire steam cleaning accessory 20. The cleaning sock 58 is made from the same material as the flexible cleaning element 32 as discussed in reference to the embodiments of FIGS. 1 to 4. The opening of the cleaning sock 58 has an elasticated band 62 or a draw string for fastening the cleaning sock 58 to the steam cleaning accessory 20. In some alternative embodiments, the cleaning sock 58 has a pocket portion (not shown) in which the finger end 61 of the steam cleaning accessory 20 is inserted and the cleaning sock 58 is fastened to the steam cleaning accessory 20 at the other end. The replaceable cleaning sock 58 can be used in conjunction with any of the other embodiments discussed herein.

Figure 6:
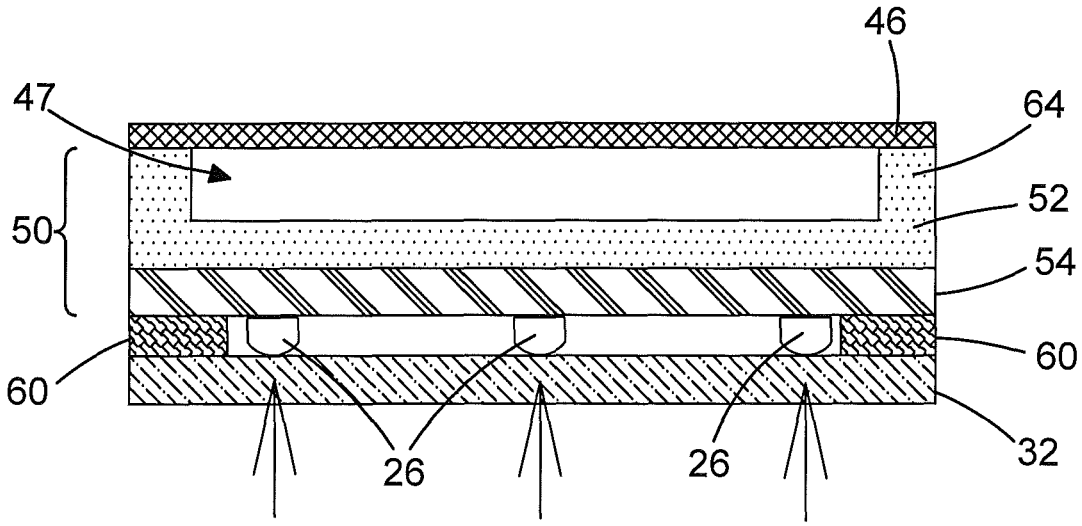
FIG. 6 shows a cross sectional front view of the steam cleaning accessory according to an embodiment.

FIG. 6 shows a front cross sectional view of the steam cleaning accessory 20 as view along cross section B-B. The steam cleaning accessory 20 is the same as the steam cleaning accessory 20 as shown in FIG. 4 and the same reference numbers will be used accordingly. The flexible cleaning element 32 is removeably mounted on the second flexible thermal insulation layer 54. The flexible cleaning element 32 is fastened to the second flexible thermal insulation layer 54 with a hook and eye arrangement 60 (e.g. VELCRO®). Alternatively any suitable fastening means can be used to removeably fasten the cleaning element 32 to the second flexible thermal insulation layer 54. For example clips or screws could be used instead. Removeably attaching the flexible cleaning element 32 to the thermal insulation layer 50 may be optionally used in conjunction with any of the other embodiments discussed herein.

The steam ducts 26 are mounted on the second flexible thermal insulation layer 54. The steam ducts 26 project down from the second flexible thermal insulation layer 54. Flexible infill material (not shown) may be located between the steam ducts 26 so that the flexible cleaning element 32 e.g. a cloth does not wrinkle or crease around the steam ducts 26. Optionally the steam ducts 26 have a "D-shaped" cross section with the flat side adjacent to the second flexible thermal insulation layer 54. The flat surface of the steam duct 26 allows the steam ducts 26 and the steam outlets 28 to be aligned before bonding to the second flexible insulation layer 54. This means that the steam outlets 28 are less likely to be pointing in the wrong direction, for example towards the user's hand because the flat surface limits rotation of the steam duct 26 during manufacture.

The first layer 52 of the flexible thermal insulation layer 50 may optionally comprise an upstanding peripheral wall 64. The upstanding peripheral wall 64 substantially encircles the user's hand. This means that the peripheral wall 64 defines an interior recess which increases the size of the pocket 47. The peripheral wall 64 also helps the user's hand remain engage with the steam cleaning accessory 20 in a central position when wiping surfaces. In other words the peripheral wall 64 gives the user something to push against when wiping the steam cleaning accessory 20 from side to side.

Figure 7:
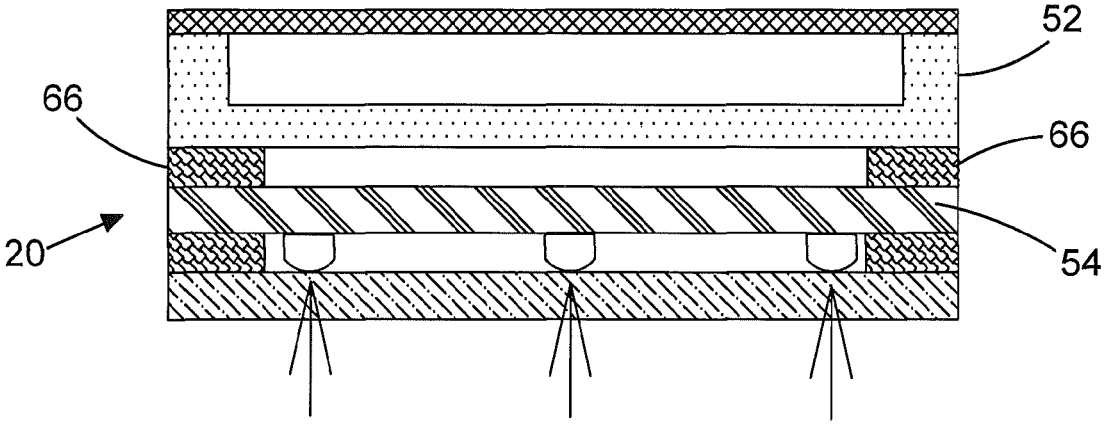
FIG. 7 shows a cross sectional front view of the steam cleaning accessory according to an embodiment.

FIG. 7 shows a front cross sectional view of another embodiment of the steam cleaning accessory 20. FIG. 7 shows a similar steam cleaning accessory 20 as shown in FIG. 6. FIG. 7 differs from FIG. 6 in that the second flexible thermal insulation layer 54 is removable from the first flexible thermal insulation layer 52. The first and second layers 52, 54 are coupled to each other by a hook and eye fastening arrangement 66 (e.g. VELCRO®). Any other suitable fastening means can be used to fasten the first and second flexible thermal insulation layers together 52, 54. By making the first and second layers flexible thermal insulation 52, 54 separable, the first flexible thermal insulation layer 52 can be washed independently of the steam ducts. Removeably attaching the first and second thermal insulation layers 52, 54 may be optionally used in conjunction with any of the other embodiments discussed herein.

Figure 8:
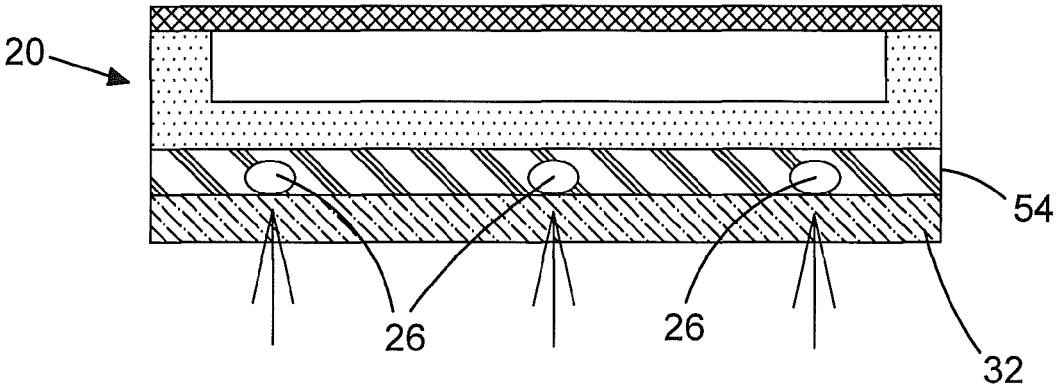
FIG. 8 shows a cross sectional front view of the steam cleaning accessory according to an embodiment.

Another embodiment of the steam cleaning accessory 20 will now be discussed in reference to FIG. 8. FIG. 8 shows a front cross sectional view of the steam cleaning accessory 20. The steam cleaning accessory 20 of FIG. 8 is similar to the steam cleaning accessory 20 described with reference to the previous embodiments. The difference is that the steam ducts 26 are embedded or partially embedded in the second flexible thermal insulation layer 54. This means that the flexible cleaning element 32 sits flush on the second flexible thermal insulation layer 54. Alternatively the steam ducts 26 may comprise integral bores completely within the second flexible thermal insulation layer 54 for providing a flow pathway for the steam. Alternatively the steam ducts 26 can be an open channel in the second flexible thermal insulation layer 54 or a combination of an internal bore and an open channel.

In another embodiment, not shown, the steam conduit is a bladder formed from two pieces of steam impermeable material bonded together. The bladder comprises a plurality of holes for releasing the steam towards the flexible cleaning element 32, similar to the previously discussed embodiments. The steam fills up the bladder and creates a steam reservoir within the steam cleaning accessory 20. In some embodiments the bladder can also form the second flexible thermal insulation layer 54. Alternatively, the bladder is formed from a single piece of material having a balloon-like construction.

Figure 9:
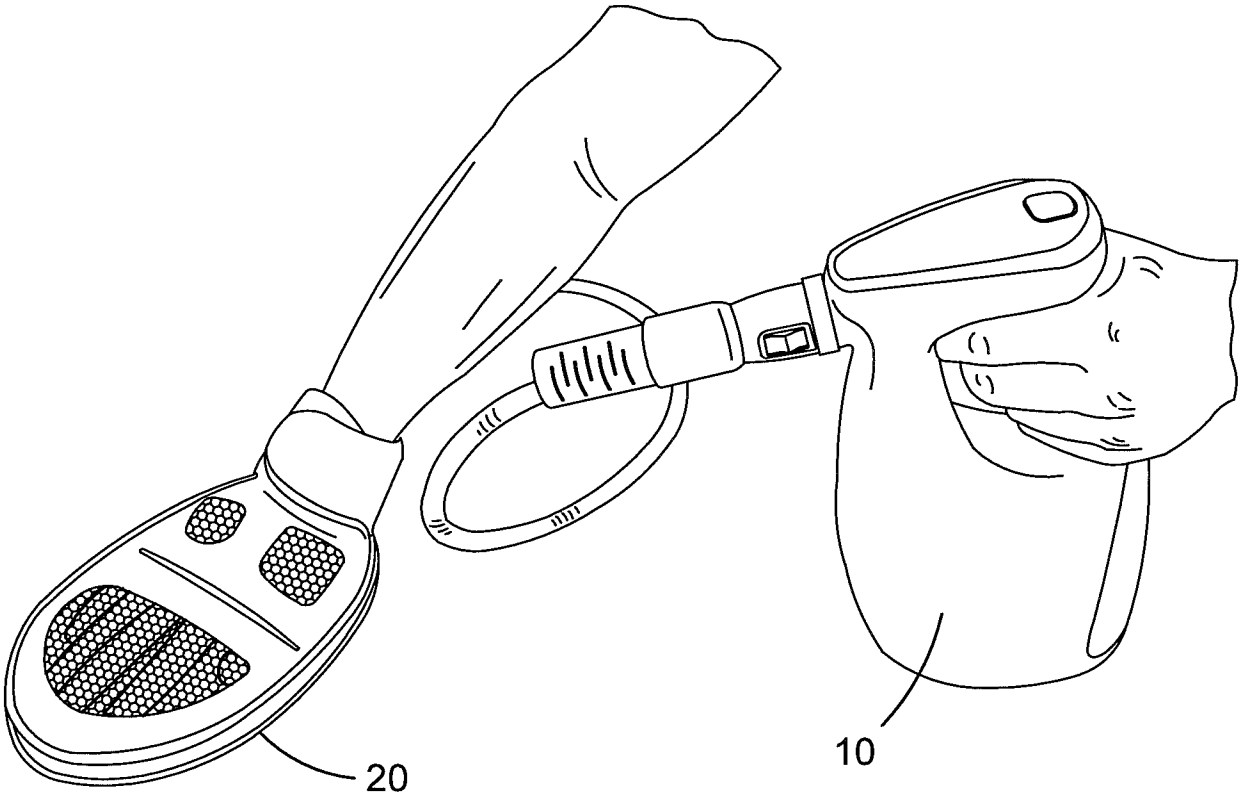
FIG. 9 shows a picture of the steam cleaning device and accessory in use.

Use of the steam cleaning accessory 20 will now discussed in reference to FIG. 9. FIG. 9 shows a photo of the steam cleaning device 10 which is held in the hand and the steam cleaning accessory 20 worn on the other hand. The steam cleaning device 10 generates steam and this flows through the steam ducts 26 and out of the steam outlets 28. The flexible thermal insulation layer 30 stops the user's hand getting hot or burnt. Since the entire steam accessory 20 is flexible, the steam accessory 20 can be deformed, bent and moulded according to the position of the user's hand. The steam cleaning accessory 20 will deform and bend around curved surfaces allowing the user to achieve a steam clean. This is particularly advantageous when cleaning toilets, showerheads, taps and sinks.

The steam cleaning device 10 may comprise a small boiler 14 which delivers between 5 ml/min to 30 ml/min of steam to the steam cleaning accessory 20. In some embodiments the boiler 14 generates 15-20 ml/min of steam. It is thought that 15-20 ml/min of steam will provide enough steam to the steam cleaning accessory 20 to achieve germ kill.

In some alternative embodiments (not shown) the steam cleaning accessory 20 comprises a first portion for one or more digits and a second portion for one or more digits. The first and second portions are independently moveable with respect to each other. The first and second portions comprises a split there between which provides a receiving space. Each layer comprises the first and second portions such that the first and second portions each respectively operates as a steam cleaning accessory 20. The first and second portions may each comprise a steam duct 26. Alternatively the steam duct 26 may optionally not extend into the first and second portion, but only extend into an area adjacent to the user's palm.

The receiving space is configured to accommodate a surface to be cleaned. In some embodiments the first portion is a thumb portion for receiving the thumb and the second portion is a finger portion for receiving one or more fingers. The thumb portion is spaced apart from the finger portion due to the natural hand shape. The receiving space is located between the thumb portion and the finger portion and is suitable for wrapping around pipes or other elongate objects. This means steam cleaning can be achieved on a round pipe more easily. In a further embodiment there is a plurality of splits in the steam cleaning accessory 20. This means that the steam cleaning accessory 20 can be a glove having from three to five separate portions, each configured to operate as a steam cleaning accessory 20.

In another embodiment (not shown), the steam cleaning accessory 20 comprises a flexible restraint for receiving less than five digits of a user's hand. For example the flexible restraint is sized only to receive two fingers (e.g. the index and the middle fingers). In other respects, the steam cleaning accessory 20 is the same as the steam cleaning accessories 20 as described in reference to the previously discussed embodiments. This means that that a flexible restraint only receiving two fingers can be smaller and this means the steam cleaning accessory 20 allows more detailed and precise cleaning.

Figure 10:
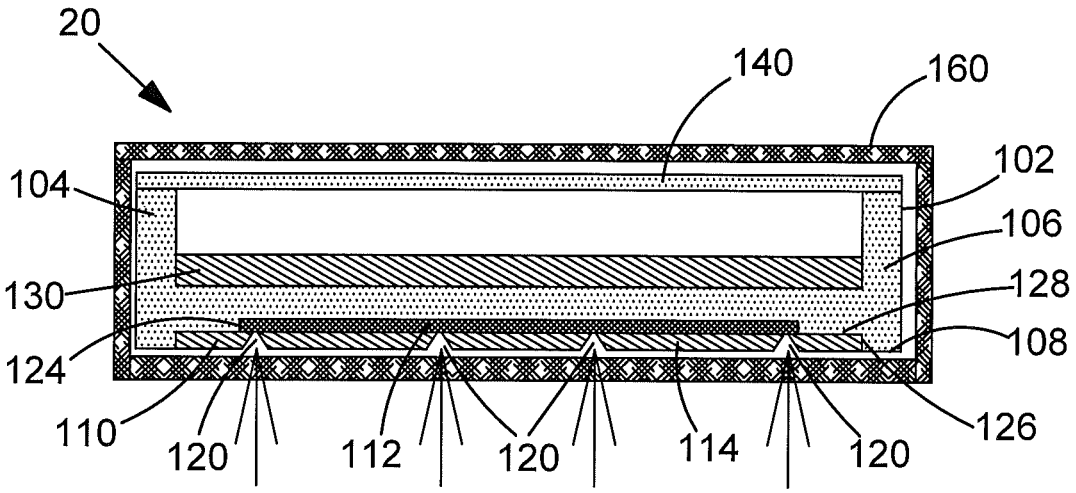
FIG. 10 shows a cross sectional front view of the steam cleaning accessory according to an embodiment.

FIG. 10 shows a cross sectional front view of the steam cleaning accessory 20 according to another embodiment. The steam cleaning accessory 20 is a modification of the previously described embodiments. The steam cleaning accessory 20 comprises a flexible body such as a flexible sheath or flexible jacket 102. Hereinafter the flexible body will be referred to as a flexible sheath 102. The flexible sheath 102 comprises a first side wall 104, a second side wall 106 and a base portion 108 there between. The flexible sheath 102 provides a structure for holding and retaining parts of the steam cleaning accessory 20. The first and second side walls 104, 106 and the base 108 may be integral and formed from the same element. In other embodiments the side walls, 104, 106 and the base 108 can be separate elements which are bonded together.

In some embodiments the flexible sheath 102 a single element and is moulded in a single shot process. The flexible sheath 102 is formed from a heat resistant silicone material.

The steam cleaning accessory 20 comprises a steam conduit 110. The steam conduit is at least one steam bladder 110 which is in fluid communication with the steam generator as described in previous embodiments. Although not shown, the steam cleaning accessory 20 is coupled to the steam generator 14 with a hose 22 which may or may not have an adaptor 24 for coupling to the steam generator 14 and/or the steam cleaning accessory 20. The steam bladder 110 comprises at least one steam outlet 120. The steam outlets 120 are one or more holes in the outer flexible layer 114. The steam bladder 110 comprises an inner flexible layer 112 and an outer flexible layer 114. The inner flexible layer 112 is mounted and bonded to the base 108. The outer flexible layer 114 comprises at least one steam outlet 120. The steam outlets 120 face away from the base 108 and direct the steam away from the steam cleaning accessory 20. In an alternative embodiment, the at least one conduit is a tube or other such means such as an open channel for transmitting steam as mentioned in reference to the previous embodiments and the at least one conduit is mounted on or in the flexible sheath 102.

Figure 11:
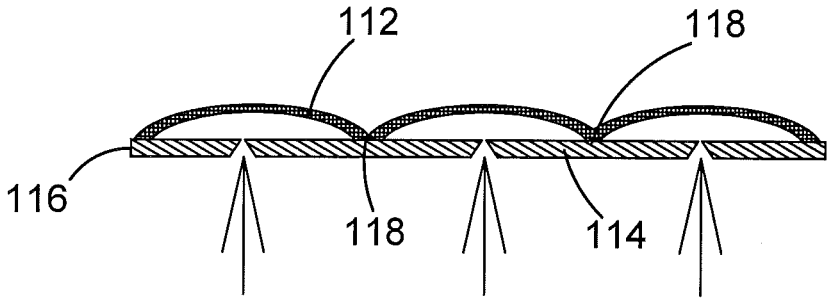
FIG. 11 shows a close up schematic view of the steam bladder according to an embodiment.

The inner flexible layer 112 and the outer flexible layer 114 are shown in more detail in FIG. 11. FIG. 11 shows a schematic view of the steam bladder 110. The inner and outer flexible layers 112, 114 are substantially bonded together around the periphery 116 of the steam bladder 110. The inner and outer flexible layers 112, 114 are optionally further bonded together at points 118 between the peripheral edge 116 of the steam bladder 110. In some embodiments the inner and outer flexible layers 112, 114 are bonded together with silicone adhesive.

Figure 13:
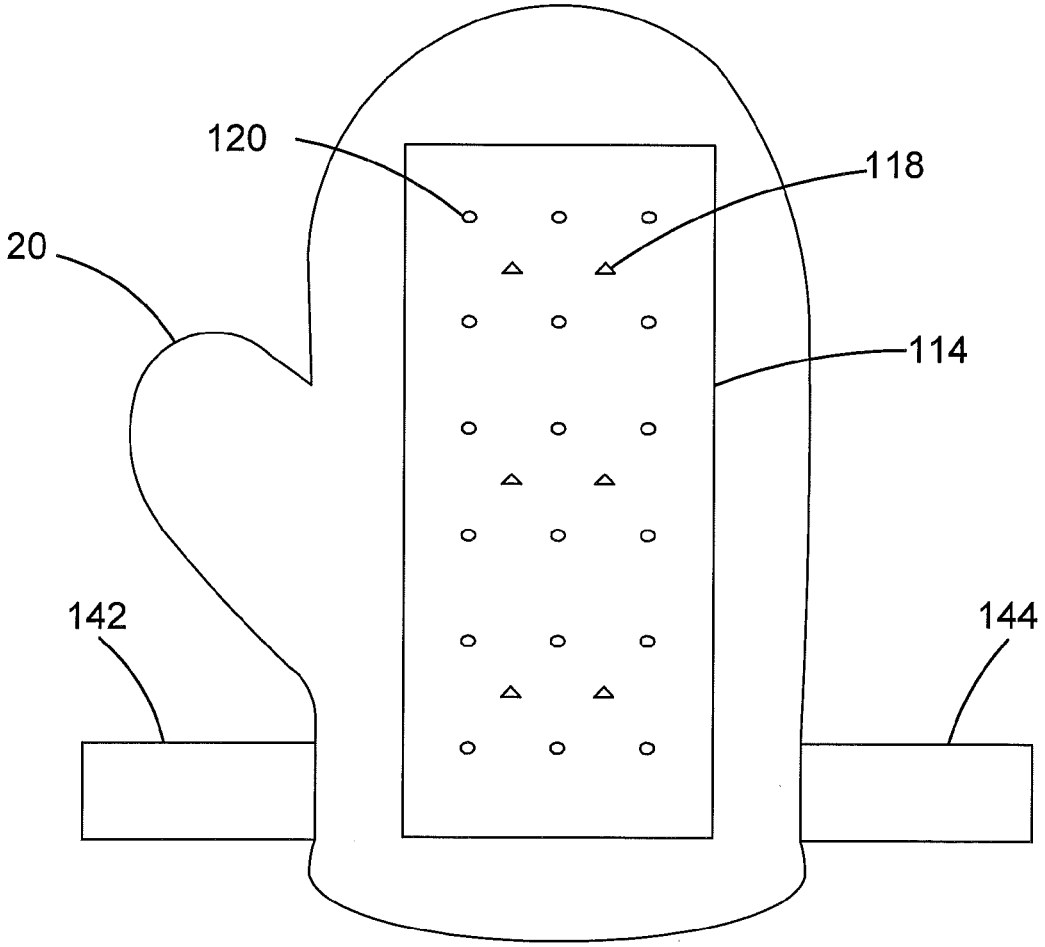
FIG. 13 shows a schematic plan view of the steam cleaning accessory according to an embodiment.

By bonding the flexible layer 112 and the outer flexible layer 114 at intermediate points 118, expansion of the steam bladder 110 when it fills with steam can be controlled. In particular the steam bladder 110 is prevented from swelling into a spherical shape which is difficult for a user to control in use. The intermediate points 118 can be a plurality of spot bonding sites. Turning to FIG. 13, which shows a schematic plan view of the steam cleaning accessory 20, the location of the intermediate bonding sites 118 will be discussed in further depth. The intermediate bonding sites 118 are shown as triangles and steam outlets 120 are shown as circles in FIG. 13. The intermediate bonding sites 118 can be spots as shown in FIG. 13. In this case the steam bladder 110 provides one reservoir of steam in use. Alternatively the steam bladder 110 can be divided into a plurality of sub-bladder portions which are separate from each other (not shown). The steam bladder 110 is subdivided by bonding the inner and outer flexible layers 112, 114 along continuous lines.

Turning back to FIG. 10, the steam bladder 110 is mounted in a recess 124 in the flexible sheath 102. The recess 124 accommodates the steam bladder 110 such that when the steam bladder 110 is mounted in the recess 124, the steam bladder 110 is flush with the underside of the base 108. In some embodiments the outer flexible layer 114 of the steam bladder 110 has a greater surface area that the inner flexible layer 112 of the steam bladder. This means that a portion 126 of the outer flexible layer 114 projects beyond the inner flexible layer 112. The projecting portion 126 provides a surface of material such that the steam bladder 110 can be bonded to a shoulder surface 128 of the recess 124. By sandwiching the base 108 between the flexible thermal insulation layer 130 and the steam bladder 110, there is an additional steam impermeable layer (the base 108) between the steam bladder 110 and the user's hand.

In some alternative embodiments the recess 124 can be replaced with a window (not shown) and the steam bladder 110 can be located within the window. A window may be preferable in order to save material costs during manufacture.

In other embodiments the steam bladder 110 can be formed from identical sized inner and outer flexible layers 112, 114. Alternatively the steam bladder 110 can be a balloon formed from a single piece of material. A steam bladder 110 is preferable to tubes as described in the previous embodiments because the tubes are difficult to locate and adhere to the steam cleaning accessory 20. By using two portions of silicone material for the steam bladder, the steam outlets 120 can accurately be made in the outer flexible layer 114 and then bonded to the inner flexible layer 112. This means that the inner flexible layer 112 can be kept away from the sharp tools when the steam outlets 120 are created in the outer flexible layer 114. This reduces the likelihood of the inner flexible layer 112 being punctured during manufacture. Advantageously, this means that the steam bladder 110 is less likely to leak steam in the direction of the user's hand.

A flexible thermal insulation layer 130 is mounted on an interior surface of the flexible sheath 102. The flexible thermal insulation layer 130 is the same as the thermal insulation layer described in reference to previous embodiments. Advantageously the flexible sheath 102 can be bonded to the flexible thermal insulation layer 130 along the inside surface of the base 108 and the inside surface of the first and second side walls 104, 106. This means that the edge of the fabric flexible thermal insulation layer 130 can be hidden and bonded to the flexible sheath without exposed scratchy edges which can irritate the user's skin. The side walls 104, 106 of the flexible sheath can constrain and hold the flexible thermal insulation layer 130. Furthermore moulding side walls 104, 106 from the flexible sheath 102 is easier than stitching or gluing walls created from the flexible thermal insulating material as described above in previous embodiments. In this way the manufacturing of the steam cleaning accessory 20 is quicker and simpler.

The steam cleaning accessory 20 further comprises a flexible pocket or restraint 140 coupled to the flexible sheath 102. Similarly to previous embodiments the restraint is arranged to couple to the user's hand and ensure the hand is located in the steam cleaning accessory 20. The restraint 140 can be the same as in previous embodiments. Additionally or alternatively, the restraint 140 may be integral with the flexible sheath 102. The restraint may be flexible and comprise a silicone material. FIG. 13 shows the restraint optionally comprising two halves 142, 144 which couple together and wrap around the user's wrist.

The steam cleaning accessory 20 comprises a flexible cleaning element 160 is removably mountable adjacent to the at least one steam outlet 120. The flexible cleaning element 160 in some embodiments is identical to the flexible cleaning element as described in reference to the previous embodiments. The flexible cleaning element 160 as shown in FIG. 10 is a fabric sock 160 which can be placed and secured over the steam cleaning accessory 20. After use, the fabric sock 160 can be removed for separate cleaning.

Figure 12:
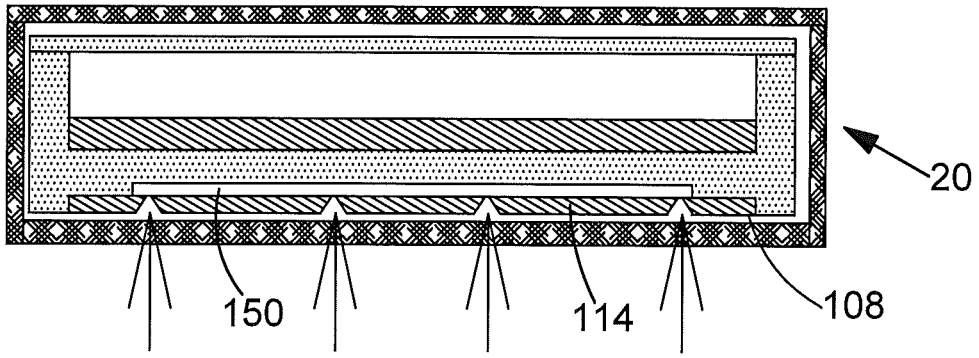
FIG. 12 shows a cross sectional front view of the steam cleaning accessory according to an embodiment.

Turning to FIG. 12 a further embodiment will be discussed. FIG. 12 shows a cross sectional front view of the steam cleaning accessory 20 according to another embodiment. The steam cleaning accessory 20 as shown in FIG. 12 is the same as in FIG. 10 except that the outer flexible layer 114 is bonded directly to the base 108. A void 150 is located between the outer flexible layer 114 and forms a steam reservoir for the steam bladder 110 during use.

In another embodiment two or more embodiments are combined. Features of one embodiment can be combined with features of other embodiments.

Embodiments of the present invention have been discussed with particular reference to the examples illustrated. However it will be appreciated that variations and modifications may be made to the examples described within the scope of the invention.

The invention claimed is:

1. A steam cleaning accessory for use with a steam generator comprising:

a flexible sheath having a first side wall, a second side wall and a base there between;

at least one steam conduit having at least one steam outlet, the at least one steam conduit being arranged to be in fluid communication with the steam generator; and at least one flexible thermal insulation layer mounted between the first and second side walls;

wherein the steam conduit is mounted on or in a first side of the base and the flexible thermal insulation layer is mounted on a second side of the base; and a restraint is coupled to the flexible sheath and arranged to receive a user's hand.

2. The steam cleaning accessory according to claim 1 wherein the at least one steam conduit is at least one steam bladder.

3. The steam cleaning accessory according to claim 1 wherein the base comprises a recess or a window for receiving the at least one steam bladder.

4. The steam cleaning accessory according to claim 1 wherein the at least one steam bladder comprises an inner flexible layer and an outer flexible layer bonded together substantially around a periphery.

5. The steam cleaning accessory according to claim 4 wherein the inner flexible layer is the base of the flexible sheath or a flexible layer bonded to the base.

6. The steam cleaning accessory according to claim 4 wherein the inner flexible layer and the outer flexible layer are bonded together at at least one point between the periphery.

7. The steam cleaning accessory according to claim 1 wherein the flexible sheath comprises single moulded material.

8. The steam cleaning accessory according to claim 1 wherein the first and second side walls substantially surround the periphery of the at least one flexible thermal insulation layer.

9. The steam cleaning accessory according to claim 1 wherein the at least one flexible thermal insulation layer is bonded to the first and second side walls and/or the base.

10. The steam cleaning accessory according to claim 1 wherein the restraint is integral with the flexible sheath.

11. The steam cleaning accessory according to claim 1 wherein the at least one flexible thermal insulation layer comprises a resilient material arranged to return to a predetermined shape after being deformed.

12. The steam cleaning accessory according to claim 11 wherein the resilient material comprises a first fabric layer and a second fabric layer and the first and second fabric layers are separated by resilient flexible threads knitted between the first and second fabric layers.

13. The steam cleaning accessory according to claim 1 wherein a flexible cleaning element is removably mountable adjacent to the at least one steam outlet.

14. A steam cleaning accessory for use with a steam generator comprising:

an adaptor for coupling to the steam generator;

at least one steam conduit in fluid communication between the adaptor and at least one steam outlet;

a flexible cleaning element for engaging with a surface, wherein the cleaning element is steam permeable;

at least one flexible thermal insulation layer wherein the at least one steam conduit is mounted between the at least one flexible thermal insulation layer and the flexible cleaning element; and a flexible restraint mounted on the flexible thermal insulation and the flexible restraint is arranged to receive a user's hand.

* * * * *